US006454829B1

(12) United States Patent
Bebber et al.

(10) Patent No.: US 6,454,829 B1
(45) Date of Patent: Sep. 24, 2002

(54) METHOD AND DEVICE FOR THE CONTINUOUS DEGASSING OF MOLTEN METALS

(75) Inventors: Hans Bebber, Mülheim; Juan Fähnrich, Pulheim-Sinthern; Günter Phillipps, Köln, all of (DE)

(73) Assignee: Induga Industrieofen und Giesserei-anlagen GmbH & Co. KG, Cologne (DE)

( * ) Notice: Subject to any disclaimer, the term of this patent is extended or adjusted under 35 U.S.C. 154(b) by 0 days.

(21) Appl. No.: 09/719,819

(22) PCT Filed: Jul. 1, 1999

(86) PCT No.: PCT/DE99/02028

§ 371 (c)(1),
(2), (4) Date: Dec. 15, 2000

(87) PCT Pub. No.: WO00/03821

PCT Pub. Date: Jan. 27, 2000

(30) Foreign Application Priority Data

Jul. 15, 1998 (DE) ..... 198 31 675

(51) Int. Cl.[7] ..... C22B 9/04

(52) U.S. Cl. ..... 75/10.12; 75/10.14; 75/387; 75/414; 75/647; 266/209; 373/141

(58) Field of Search ..... 75/647, 10.12, 75/10.14, 387, 414; 266/209; 373/141

(56) References Cited

U.S. PATENT DOCUMENTS

| | | | |
|---|---|---|---|
| 3,310,850 A | 3/1967 | Armbruster | |
| 3,402,921 A | 9/1968 | Hart | |
| 3,706,449 A | * 12/1972 | Anderson et al. | 266/240 |

FOREIGN PATENT DOCUMENTS

| | | | |
|---|---|---|---|
| BE | 556194 | 4/1957 | |
| CH | 606 452 | 10/1978 | |
| DE | 1 103 950 | 4/1961 | |
| DE | 2 058 669 | 5/1972 | |
| DE | 36 09 900 C2 | 11/1986 | |
| EP | 0 134 336 A1 | 3/1985 | |
| JP | 54099729 | 8/1979 | |
| JP | 59010448 | 1/1984 | |
| JP | 61056760 | 3/1986 | |
| JP | 61166912 | 7/1986 | |
| JP | 01040153 | 2/1989 | |
| JP | 1-142016 | * 6/1989 | 266/209 |

* cited by examiner

*Primary Examiner*—Melvyn Andrews
(74) *Attorney, Agent, or Firm*—Herbert Dubno

(57) ABSTRACT

The invention relates to a method and a device for the continuous degassing of molten metals and subsequent casting of the degassed metal, according to which the molten metal is guided into a vacuum for the purpose of degasification and after degasification is transferred into a casting chamber. To make it possible to carry out these operations continuously and to prevent the degassed metal from coming into contact with untreated metal, the invention provides for the molten metal to be transferred from a first chamber via an ascension pipe having an inlet opening located below the level of the metal bath into a vacuum chamber serving as degasification chamber by utilizing only the lift force resulting from the pressure differential between the vacuum chamber and the first chamber and no other means of transport. From the vacuum chamber the molten meal by gravity flows into the downpipe whose outlet opening is below the level of the molten metal bath in the casting chamber and enters the casting chamber.

12 Claims, 2 Drawing Sheets

METHOD AND DEVICE FOR THE CONTINUOUS DEGASSING OF MOLTEN METALS

CROSS REFERENCE TO RELATED APPLICATIONS

This application is a national stage of PCT/DE99/02028 filed Jul. 1, 1999 and based upon German national application 198 31 675.5 of Jul. 15, 1998 under the International Convention.

FIELD OF THE INVENTION

The present invention relates to a method for the continuous degassing of molten metals, especially molten copper, and for subsequent casting of the degassed metal whereby the metal melt is fed for degassing into a vacuum and after the degassing is transferred into a casting chamber.

The invention relates further to an apparatus for the continuous degassing of molten melts, especially molten copper, and subsequent casting of the degassed metal, with a vessel receiving the molten metal, a standpipe extending into the chamber of this vessel and having an upper end which opens into a degassing space, and an outlet for the molten metal.

BACKGROUND OF THE INVENTION

In metallurgy, degassing of metal melts is known also as vacuum treatment. This includes metal melt after-treatments under greatly reduced pressures which enable dissolved gases in the metal melt, especially hydrogen, to be removed in an environment with reduced ambient pressure. The degassing which is here of interest usually subjects only a part of the liquid melt to the vacuum either by a vacuum circulation degassing or a vacuum lift degassing.

In vacuum circulation degassing, two tubular columns from an evacuated vessel extend below the melt surface in a casting ladle. A transport gas is fed into one of the two columns to produce a circulation and raise the metal melt into the vacuum vessel. The melt is there atomized and the desired reaction takes place. Through the other column, the degassed metal melt returns to the ladle. After a certain duration the entire content of the ladle has been passed through the vacuum vessel and degassed. The vacuum lift process, involves raising and lowering the vacuum vessel, whose column-like ends are immersed in the melt. Upon lowering the vacuum vessel, a part of the melt rises because of the vigorous movement into the vacuum vessel. If the vacuum vessel is then lifted, the steel flows by its own weight back into the ladle. By repeated operations partial quantities of the melt are caused to flow repeatedly into the degassing space so that after a treatment time of about 15 minutes, the ladle contents has passed a number of times through the degassing vessel and has been degassed.

DE 36 09 900 C2 describes a conventional process technology and device which utilizes this principle. With this process and device, at least two vacuum chambers are provided into which the molten metal is pumped up. One of these vacuum chambers is utilized for the degassing while the molten metal is ejected from the other vacuum chamber and can be mixed with the molten metal in the supply vessel. The two vacuum chambers alternately degas the molten metal. To maintain the molten state of the metal, the vacuum chambers are inductively heated. By means of this technology, however, only a quasi-continuous mode of operation is possible in that the bath level variations can only be held within narrow limits and within which the two vacuum chambers suck in the liquid metal melt and eject it. The drawback is not only the need to have two vacuum chambers in operation but also that the treated metal is mixed with the untreated metal since no forced circulation can be insured.

There are also known processes in which the metal melt is degassed in a separate furnace vessel optimized only for vacuum treatment. The melt is then cast. However with this process, apart from its high apparatus cost, additional time must be taken for molten metal aftertreatment which can give rise in a continuous casting system to increased production costs. Correspondingly, for the so-called casting jet degassing in which a casting jet is fed into a vacuum atmosphere the same applies.

Finally, degassing with a flushing gas is also used to create a substantial partial pressure differential for hydrogen separation. The efficiency of this process is, however, quite low.

A preferred field of application of the present process is in the production of oxygen-free copper (OF-copper). In this process, aside from low copper contents of the order of magnitude of 1 to 3 ppm, also low hydrogen contents of typically below 1 ppm can be achieved. This utilizes the principle that the hydrogen solubility in copper decreases with falling pressure and that normally hydrogen dissolved in copper can be removed under vacuum conditions from the metal without again increasing the oxygen content.

OBJECT OF THE INVENTION

It is the object of the present invention to provide a method and an apparatus as stated at the outset which are so improved that a completely continuous mode of operation is possible, that the degassed metal does not come into contact with the untreated metal and that the apparatus and process technology costs are maintained as low as possible.

SALARY OF THE INVENTION

The object is achieved in a method whereby according to the invention the metal melt from a first chamber is transferred via a riser pipe [ascension tube] with an inlet opening lying beneath the bath level into a vacuum chamber serving as a degassing space and from there by gravity into a descending tube with a lower outlet opening which preferably lies below the bath level in the casting chamber and to the casting chamber. This process technique has the advantage that the metal melt which is transferred to the casting chamber is completely degassed by previous passage through the vacuum chamber. A mixing of the already degassed metal melt with an untreated metal melt is avoided.

Furthermore, only one vacuum chamber is required which is solely utilized for degassing and the lifting force produced in the first vessel suffices without any additional conveyor means to transfer the metal melt to the vacuum chamber and from it to the casting chamber. In contrast to the process of the state of the art, a continuous process is possible according to the invention.

Thus by controlling the metal melt feed into the first chamber and the discharge of the metal melt from the casting chamber, the bath surfaces in the first chamber and in the casting chamber can be set at different height levels. By means of the riser tube and the descending tube, a connection is made between the two chambers of the communicating pipe type, whereby corresponding to a height difference between the higher bath level in the first chamber and the bath surface in the casting chamber, a metal melt flow is maintained.

From the casting chamber the metal melt can be continuously or discontinuously discharged.

According to a further preferred feature, the first and second chambers adjoin one another and are subdivided in a lower region by a dam into two bath chambers. If the bath surface in the first and the second chambers lie below the upper edge of the dam, the metal melt is fed from the first chamber via the riser or ascension tube into the vacuum chamber and from there is fed via the descending tube into the casting chamber.

Should the vacuum chamber fill, for example as a result of a pumping defect or also in cases in which no degassing is desired, the bath surfaces can be so adjusted that they lie above the edge of the mentioned dam and that in the first and second chambers a common continuous bath level is formed and molten metal tends to flow directly into the casting chamber, bypassing the vacuum chamber.

To insure the flowability of the metal melt especially in the starting phase, the ascension tube and descent tube are heated.

The heating can be carried out especially with burners.

The degassing kinetics are very strongly dependent upon the temperature and for that reason in accordance with a further feature of the invention the metal melt is inductively heated and thus it is possible to control the degassing by the inductive heating of the melt.

According to a further feature of the invention, the retention time of the metal melt in the vacuum chamber is controlled by the pressure in this vacuum chamber.

From an apparatus point of view, the object of the present invention can be achieved with an apparatus in which the ascension tube extends into a first chamber which is supplied with the molten metal. A vacuum chamber for degassing is provided in the bottom of which the upper end of the ascension tube opens. The bottom has an outflow opening which is connected with a descending tube whose lower end forms an outlet opening in a second chamber configured as a casting chamber with an outlet nozzle.

The first and second chambers can be spatially connected together and can have a dam which subdivided the chambers in their lower region into two bath chambers, whereby the riser tube and the descending tube open in the different chambers below the upper dam edge. As already described previously, the molten metal which is present in the first chamber can only pass via the riser tube, the vacuum chamber and the descending tube as long as the bath levels on opposite sides of the dam lie below the upper dam edge.

This can be achieved by controlling the melt inflow into the first chamber as well as the discharge of the treated metal from the casting chamber. Upon failure of the vacuum chamber, the dam overflows so that the casting process will not be interrupted when no degassing is desired or there is a vacuum chamber failure.

Preferably, the riser tube and the descending tube are mutually parallel to another and vertical.

According to a feature of the invention, the riser tube and the descending tube are heated, especially by means of a burner.

With corresponding control or regulation it can be insured that the bath levels below or above the upper dam edge are adjustable. Preferably for temperature control of the metal melt in the inlet region an inductor is arranged with which a heating of the metal melt to a desired temperature can be insured for control of the degassing during continuous operation. To prevent undesired atmospheric influences on the casting chamber it can be hermetically sealed toward the exterior by a weir which ends below the bath level.

SPECIFIC DESCRIPTION

Figure 1:
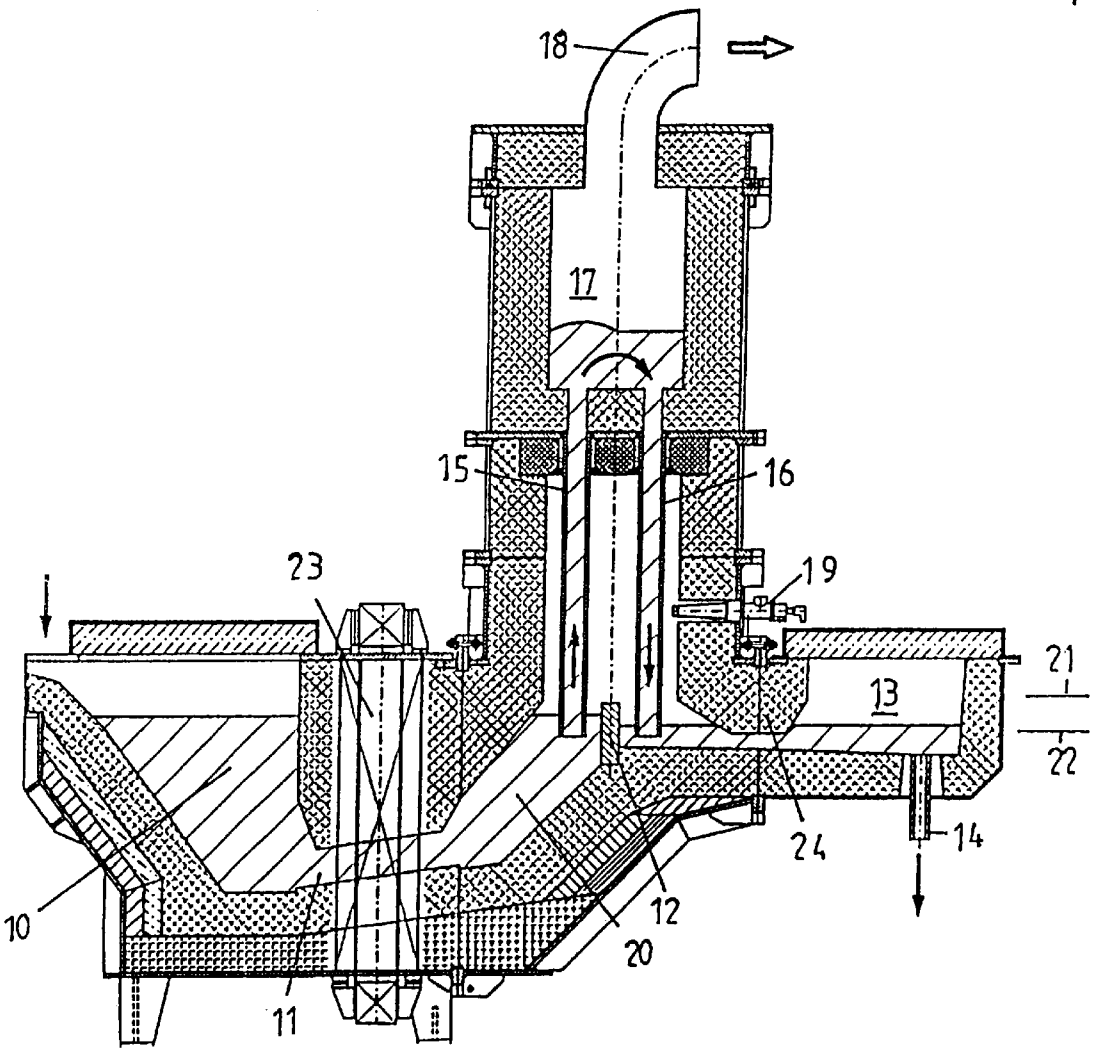
FIG. 1 is a respective cross section through an apparatus according to the invention.

The illustrated apparatus comprises an intake chamber into which a liquid metal is continuously fed from a preceding storage furnace. From this intake chamber 10 the molten metal flows through an inductor channel 11, or a plurality of inductor channels 11, into the first chamber 20 into which a vertically arranged riser tube 15 extends so that the riser tube has its lower opening below the bath level in the first chamber 20.

The riser tube 15 and the descending tube 16, which extends into a casting chamber 13 and whose lower opening is also below the bath level therein, are in the form of columns opening into the bottom of the vacuum chamber 17 which is evacuatable by 5 means of a pipe fitting 18 and a pump. The casting chamber 13 and the first chamber 20 are separated from one another by a dam 12. As long as the bath level in the intake chamber 10 or the first chamber 20 is adjusted between the limits 21 and 22, the molten metal can, as can be see from FIG. 1, pass from the first chamber 20 through only riser tube 17 and the descending tube into casting chamber 13.

Figure 2:
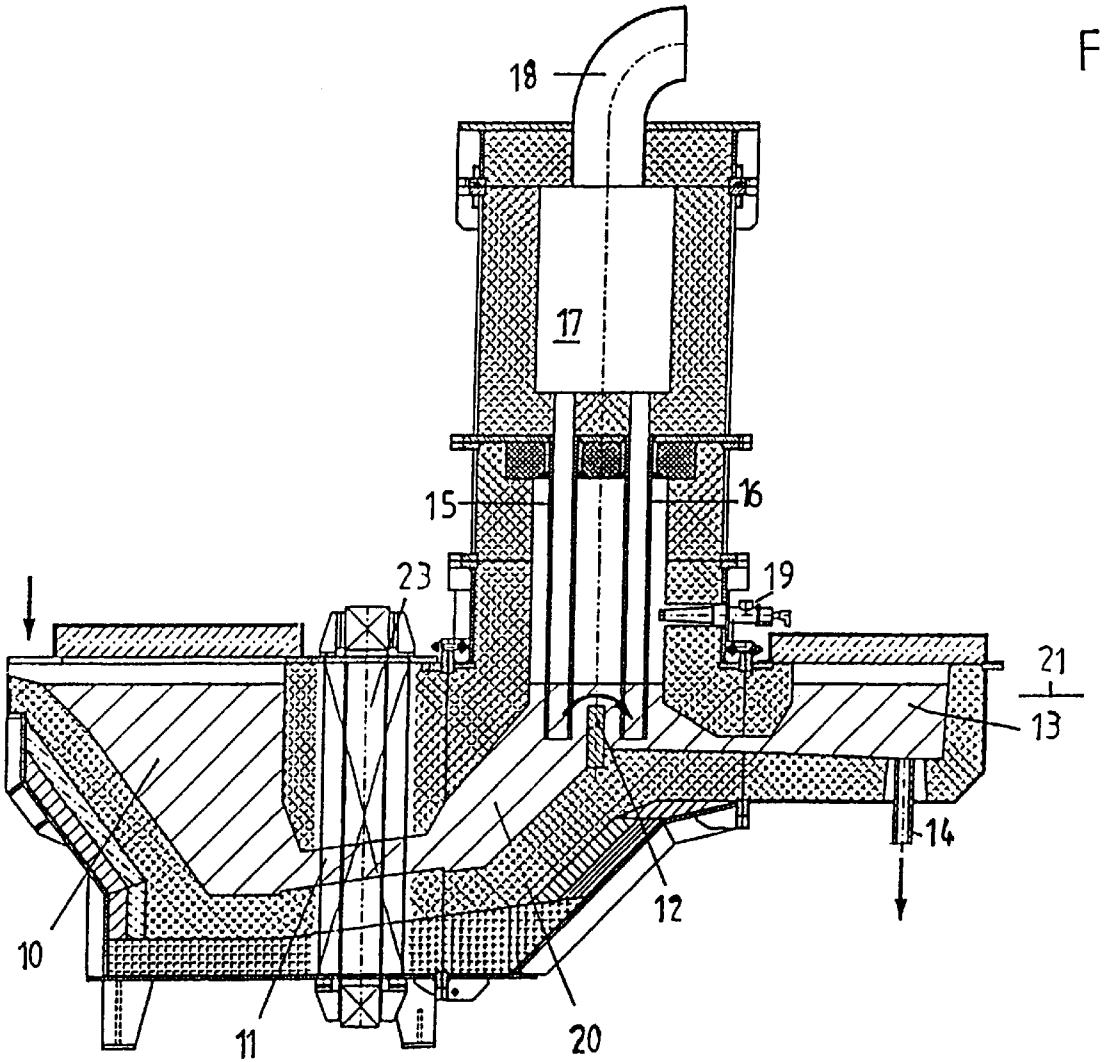
FIG. 2 is a cross section corresponding to FIG. 1 showing another condition.

If the maximum line 21 for the bath level in the first chamber 20 is exceeded, the molten metal flows as can be seen from FIG. 2 directly into the casting chamber 13, a case which is utilized when the molten metal is not to be degassed or the vacuum chamber pumps an operative for some other reason. In the inlet region there is in addition an inductor 23 by means of which the flowable metal melt is heated up. This inductor represents an ideal means for controlling the degassing which is highly temperature dependent.

For thermal stabilization during the start up phase, burner 19 is provided which heats the riser tube 15 and descending tube 16.

By comparison with an inductive heating, this burner heating has the advantage that it permits a preheating of the entire chamber including the riser tube. The casting chamber 13 also comprises a nozzle 14 through which the molten metal can be discharged. To protect the degassed metal from access by air, the casting chamber 13 is separated from the furnace atmosphere by a weir 24 so that the casting chamber is hermetically sealed against the exterior. The weir ends with its lower edge below the bath level in the casting chamber.

The apparatus of the invention operates as follows:

via a feed, the intake chamber 10 is supplied with molten metal continuously, whereby the bath level lies between the limits 21 and 22. Simultaneously a reduced pressure is established in the vacuum chamber which is effective to draw the molten metal up via the riser tube 15 into the vacuum chamber 17 where it is degassed. The molten metal falls via the descending tube 16 on the other side of the dam 12 into the casting chamber 13 whose bath level lies below the level of the bath of the intake chamber. During the degassing the burner 19 is operated to maintain a satisfactory temperature of the riser and the descending column. The level of the bath in the vessel 22 depends on the static pressure in the vacuum chamber 17.

After ending of the vacuum treatment or in the case that no vacuum treatment is necessary or desirable, the bath level in the first chamber 20 is so adjusted that the dam 12 is overflown so that the molten metal passes directly into the casting chamber.

What is claimed is:

1. An apparatus for degassing a molten metal and casting a degassed molten metal, comprising:

a first chamber receiving a flow of molten metal to be degassed and forming a first bath having an upper surface;

a second chamber separable from said first chamber and forming a casting chamber having an outlet for discharging a casting flow of molten metal, said second chamber receiving a second bath of molten metal having an upper surface;

a vacuum chamber located above said first and second chambers and having a riser tube connecting a bottom of said vacuum chamber with said first chamber and extending downwardly through said upper surface of said bath in said first chamber to open below said upper surface in said first chamber, a descending tube connecting a bottom of said vacuum chamber with said second chamber and extending downwardly through said upper surface of said bath in said second chamber to open below said upper surface in said second chamber, and means for applying suction to said vacuum chamber, whereby flow of said molten metal upwardly in said riser tube is effected solely by a pressure difference between said vacuum chamber and said upper surface of said first bath, said molten metal is degassed in said vacuum chamber and degassed molten metal flows from said vacuum chamber through said descending tube to said second bath; and means for directly heating said riser tube and said descending tube.

2. The apparatus defined in claim 1 wherein said first and second chamber are adjacent one another and are separated with an upwardly extending dam having an upper edge, said riser tube and said descending tube opening into said first bath and said second bath, respectively, below said edge.

3. The apparatus defined in claim 1 wherein said tubes are both vertical and are parallel to one another.

4. The apparatus defined in claim 1 wherein said means for directly heating said riser tube and said descending tube includes at least one burner directed at said tubes.

5. The apparatus defined in claim 4, further comprising a weir extending downwardly into said second bath and hermetically sealing said casting chamber.

6. The apparatus defined in claim 5, further comprising an inductor for heating the metal of said first bath.

7. A method of degassing a molten metal and casting a degassed molten metal, comprising the steps of:

feeding a flow of a molten metal to be degassed to a first chamber forming a first bath having an upper surface;

casting degassed molten metal from a second chamber separable from said first chamber and forming a casting chamber having an outlet for discharging a casting flow of molten metal, the molten metal in said second chamber forming a second bath having an upper surface;

applying suction to a vacuum chamber located above said first and second chambers and having a riser tube connecting a bottom of said vacuum chamber with said first chamber and extending downwardly through said upper surface of said bath in said first chamber to open below said upper surface in said first chamber and a descending tube connecting a bottom of said vacuum chamber with said second chamber and extending downwardly through said upper surface of said second bath in said second chamber to open below said upper surface in said second chamber, whereby flow of said molten metal upwardly in said riser tube is effected solely by a pressure difference between said vacuum chamber and said upper surface of said first bath, said molten metal is degassed in said vacuum chamber and degassed molten metal flows from said vacuum chamber through said descending tube to said second bath; and directly heating said riser tube and said descending tube.

8. The method defined in claim 7, further comprising the step of establishing different levels of said surfaces by controlling flow of the molten metal into said first chamber and out of said casting chamber.

9. The method defined in claim 7 wherein said chamber are adjacent one another and separated by an upwardly extending edge, further comprising maintaining said surfaces below said edge of said dam for vacuum degassing of the molten metal, and raising said surface of said first bath above said edge to bypass vacuum degassing of the molten metal.

10. The method defined in claim 7 wherein said tubes are heated by burners at least during a startup of vacuum degassing.

11. The method defined in claim 7, further comprising the step of controlling a residence time of the molten metal in said vacuum chamber by regulating a pressure therein.

12. The method defined in claim 7, further comprising controlling a temperature of the molten metal by inductively heating same.

* * * * *